US010753336B2

(12) United States Patent
Wollitzer et al.

(10) Patent No.: US 10,753,336 B2
(45) Date of Patent: Aug. 25, 2020

(54) IGNITION DEVICE FOR IGNITING AN AIR/FUEL MIXTURE IN A COMBUSTION CHAMBER

(71) Applicant: Rosenberger Hochfrequenztechnik GmbH & Co. KG, Fridolfing (DE)

(72) Inventors: Michael Wollitzer, Fridolfing (DE); Gunnar Armbrecht, Mühldorf am Inn (DE); Martin Fuchs, Freilassing (DE); Peter Awakowicz, Bochum (DE); Thomas Musch, Bochum (DE); Sven Gröger, Bochum (DE); Andre Bergner, Bottrop (DE); Gordon Notzon, Bochum (DE); Marcel Van Delden, Bochum (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/088,575

(22) PCT Filed: Mar. 23, 2017

(86) PCT No.: PCT/EP2017/000362
§ 371 (c)(1),
(2) Date: Sep. 26, 2018

(87) PCT Pub. No.: WO2017/167437
PCT Pub. Date: Oct. 5, 2017

(65) Prior Publication Data

US 2019/0113016 A1 Apr. 18, 2019

(30) Foreign Application Priority Data

Mar. 29, 2016 (DE) ..... 10 2016 003 791

(51) Int. Cl.
*F02P 15/08* (2006.01)
*F02P 3/01* (2006.01)
(Continued)

(52) U.S. Cl.
CPC ..... *F02P 15/08* (2013.01); *F02P 3/01* (2013.01); *F02P 9/007* (2013.01); *F02P 3/0407* (2013.01);
(Continued)

(58) Field of Classification Search
CPC .... F02P 15/08; F02P 9/007; F02P 3/01; F02P 3/0407; H01T 15/00; H01T 13/46; H01T 2/02
See application file for complete search history.

(56) References Cited

U.S. PATENT DOCUMENTS 5,983,871 A 11/1999 Gordon
2008/0006253 A1* 1/2008 Batchvarov ..... F02P 3/01 123/606
(Continued)

FOREIGN PATENT DOCUMENTS

DE 102004058925 A1 6/2006
DE 102005037256 A1 2/2007
(Continued)

*Primary Examiner* — Joseph J Dallo
(74) *Attorney, Agent, or Firm* — DeLio Peterson & Curcio LLC; Robert Curcio

(57) ABSTRACT

An ignition device for igniting an air-fuel mixture in a combustion chamber, in particular an internal combustion engine, having a spark plug, which has a first electrode and a second electrode, and a high voltage source for generating an electrical high voltage pulse at an output of the high voltage source and having a high frequency voltage source for generating an electrical high frequency alternating voltage at an output of the high frequency voltage source, wherein the output of the high voltage source is electrically connected to the first electrode of the spark plug via a first
(Continued)

electrical conductor path such that the high voltage pulse is applied to the first electrode, wherein the second electrode is electrically connected to an electrical ground potential, wherein the spark plug has a third electrode, wherein the output of the high frequency voltage source is electrically connected to the third electrode via a second electrical conductor path, such that the high frequency alternating voltage is applied to the third electrode.

15 Claims, 2 Drawing Sheets

(51) Int. Cl.

| | |
|---|---|
| ***F02P 9/00*** | (2006.01) |
| *F02P 3/04* | (2006.01) |
| *H01T 2/02* | (2006.01) |
| *H01T 13/46* | (2006.01) |
| *H01T 15/00* | (2006.01) |

(52) U.S. Cl.
CPC ..... *H01T 2/02* (2013.01); *H01T 13/46* (2013.01); *H01T 15/00* (2013.01)

(56) References Cited

U.S. PATENT DOCUMENTS

| | | | | |
|---|---|---|---|---|
| 2009/0229581 | A1 | 9/2009 | Ikeda | |
| 2014/0261346 | A1* | 9/2014 | Tanaya | F02P 3/02 123/594 |
| 2015/0115827 | A1* | 4/2015 | Itoi | H01T 15/00 315/224 |
| 2016/0138552 | A1* | 5/2016 | Itoi | F02P 9/002 315/127 |

FOREIGN PATENT DOCUMENTS

| | | | |
|---|---|---|---|
| DE | 102008051185 | A1 | 11/2009 |
| DE | 102013215663 | A1 | 9/2014 |
| EP | 2065592 | A1 | 6/2009 |
| EP | 2178181 | A1 | 4/2010 |
| EP | 2615704 | A1 | 7/2013 |
| EP | 2687714 | A2 | 1/2014 |
| JP | 2008082286 | A | 4/2008 |
| JP | 2009281188 | A | 12/2009 |
| JP | 2010101174 | A | 5/2010 |
| JP | 2011150830 | A | 8/2011 |

* cited by examiner

IGNITION DEVICE FOR IGNITING AN AIR/FUEL MIXTURE IN A COMBUSTION CHAMBER

BACKGROUND OF THE INVENTION

1. Field of the Invention

The invention relates to an ignition device for igniting an air/fuel mixture in a combustion chamber, in particular of an internal combustion engine, having a spark plug which has a first electrode and a second electrode, having a high voltage source or high DC voltage source for generating an electrical high voltage pulse or high DC voltage pulse at an output of the high voltage source and having a high frequency voltage source or high frequency alternating voltage source for generating an electrical high frequency alternating voltage at an output of the high frequency voltage source, wherein the output of the high voltage source is electrically connected to the first electrode of the spark plug via a first electrical conductor path such that the high voltage pulse is applied to the first electrode, wherein the second electrode is electrically connected to an electrical ground potential.

2. Description of Related Art

The so-called Otto combustion processes with direct fuel injection offer considerable potential for reducing consumption due to the possibility of implementing a stratified charging in the combustion chamber. However, the inhomogeneous mixture in the combustion chamber places increased requirements on the ignition method used in terms of achieving a reliable ignition at the appropriate time. For example, fluctuations of any kind reduce the quality of the ignition and thus the overall efficiency of the engine. On the one hand, the position of the ignitable mixture can vary slightly, and on the other hand the hook of the ground electrode of the spark plug can interfere with the formation of the mixture. Helpful for a direct injection combustion process is an ignition system with a greater spatial extension into the combustion chamber. To this end, DE 10 2004 058 925 A1 suggests igniting a fuel-air-mixture in a combustion chamber of an internal combustion engine by means of a plasma. A corresponding high frequency plasma ignition device comprises a series resonant circuit with an inductance and a capacitance and a high frequency source for resonant excitation of this series resonant circuit. The capacitance is represented by inner and outer conductor electrodes with an interposed dielectric. The outermost ends of these electrodes extend into the combustion chamber spaced apart at a specified distance.

A method for ignition is known from DE 10 2008 051 185 A1 in which a discharge plasma is generated by means of a high voltage pulse which is then further heated by means of an HF field and thereby transforms into a corona discharge. The high voltage pulse and an output signal of an HF generator are thereby fed jointly to a spark electrode of a spark plug. A return electrode of the spark plug is earthed.

Nowadays, modern ignition systems for petrol engines comprise a spark plug and a single ignition coil with electronic control unit. The spark plug has a coaxial structure and consists substantially of a central electrode surrounded by an insulator and an outer electrode which is connected to the spark plug housing. The ignition coil supplies the spark plug with a high voltage pulse or high DC voltage pulse. A spark is generated between the electrodes which initiates the combustion. An alternative method in which, in addition to the applied high voltage from the ignition coil, a high frequency voltage is applied to the spark plug is described in DE 10 2013 215 663 A1. The discharge plasma hereby transforms into an HF plasma.

In the classic ignition concepts described above, the discharge plasma burns between two electrodes, an active "driven" electrode (also referred to as the high voltage electrode) and a passive electrode (also referred to as the ground electrode), the potential of which is connected to the ground (0 V) of the engine block as well as the whole bodywork of a car. The ground electrode can also be designed as a multiple electrode. These ignition systems have the disadvantage, arising from the underlying principle, of a lack of controllability, since following the ignition of the plasma the energy stored in the ignition coil is coupled into the plasma over a time scale of a few tens of nanoseconds. The steep rise in current is a consequence of the rapidly increasing electron density and the associated increase in the conductivity of the plasma. All subsequent processes in the plasma are simply a consequence of this input of energy and can no longer be influenced externally. In particular, no further heating of the plasma takes place. The result of this is that no significant generation of free electrodes and thus of reactive species, for example atomic oxygen, which promote combustion, takes place. The combustion, on the other hand, takes place over considerably longer time scales, but relies on the previously generated atomic oxygen density.

SUMMARY OF THE INVENTION

The invention is based on the problem of improving an ignition device in terms of the possibilities for influencing the parameters of the plasma between the electrodes of the spark plug.

According to the invention this problem is solved through an ignition device according to the independent claims. Advantageous variants of the invention are described in the further dependent claims.

The above and other objects, which will be apparent to those skilled in the art, are achieved in the present invention which is directed to an ignition device for igniting an air/fuel mixture in a combustion chamber, having a spark plug which has a first electrode and a second electrode, having a high voltage source for generating an electrical high voltage pulse at an output of the high voltage source and having a high frequency voltage source for generating an electrical high frequency alternating voltage at an output of the high frequency voltage source, wherein the output of the high voltage source is electrically connected to the first electrode of the spark plug via a first electrical conductor path such that the high voltage pulse is applied to the first electrode, wherein the second electrode is electrically connected to an electrical ground potential, wherein the spark plug has a third electrode, and wherein the output of the high frequency voltage source is electrically connected to the third electrode via a second electrical conductor path such that the high frequency alternating voltage is applied to the third electrode, and an isolating element in the form of a band pass filter is electrically looped into the second electrical conductor path between the third electrode of the spark plug and the output of the high frequency voltage source, wherein the band pass filter is configured with a capacitance and an inductance.

The ignition device having the high voltage source is designed in the form of an ignition coil.

A protective circuit may be electrically looped into the second electrical conductor path between the third electrode of the spark plug and the output of the high frequency voltage source which blocks a sparkover of the high voltage pulse from the high voltage source to the output of the high frequency voltage source.

The isolating element is preferably looped into the second electrical conductor path between the protective circuit and the output of the high frequency voltage source.

The isolating element may be looped into the second electrical conductor path between the protective circuit and the third electrode.

A protective circuit may be electrically looped into the first electrical conductor path between the output of the high voltage source and the first electrode of the spark plug which represents a ground reference for the HF.

In a first alternative, on application of the high voltage pulse to the first electrode a first conductive plasma channel is formed between the first electrode and the second electrode and on application of the high frequency alternating voltage to the third electrode a third conductive plasma channel is formed between the third electrode and the second electrode.

In a second alternative, on application of the high voltage pulse to the first electrode a second conductive plasma channel is formed between the first electrode and the third electrode and a third conductive plasma channel is formed between the third electrode and the second electrode.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
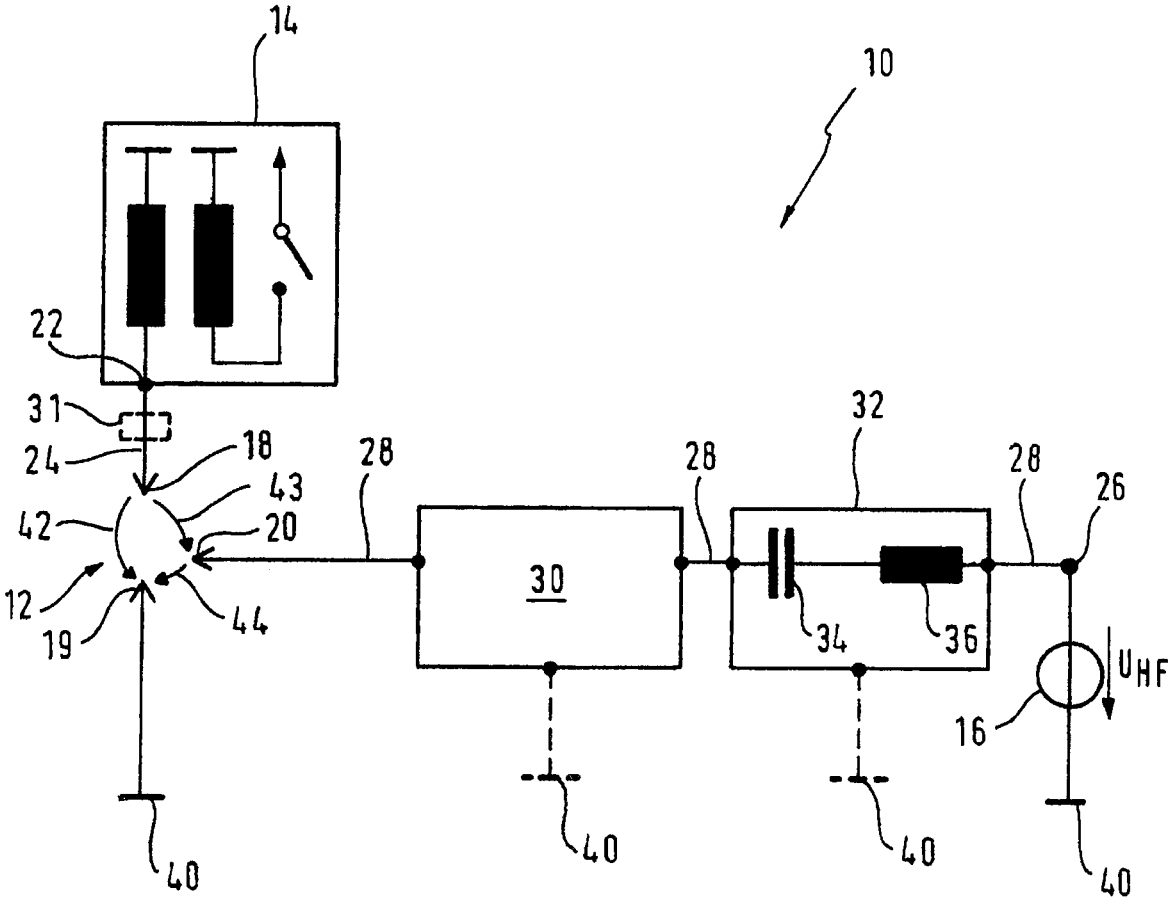
FIG. 1 shows a schematic representation of a preferred embodiment of an ignition device according to the invention.

In describing the preferred embodiment of the present invention, reference will be made herein to FIGS. 1-2 of the drawings in which like numerals refer to like features of the invention.

In an ignition device, according to the invention the spark plug has a third electrode, wherein the output of the high frequency voltage source is electrically connected to the third electrode via a second electrical conductor path such that the high frequency alternating voltage is applied to the third electrode.

This has the advantage that two active electrodes are available so that, following the ignition of a plasma between the two electrodes of the spark plug through the high voltage pulse, the high frequency alternating voltage can immediately continue to couple energy into the plasma at a significantly lower level of the electrical voltage.

The frequency-selective transmission, for example of only a desired frequency band, from the high frequency voltage source to the third electrode of the spark plug is achieved in that an isolating element in the form of a frequency-selective filter, in particular in the form of a band pass filter, is electrically looped into the second electrical conductor path between the third electrode of the spark plug and the output of the high frequency voltage source.

A particularly simple and functionally reliable ignition device is achieved in that the high voltage source is designed in the form of an ignition coil.

A protection of the high frequency voltage source against overvoltage is achieved in that a protective circuit is electrically looped into the second conductor path between the third electrode of the spark plug and the output of the high frequency voltage source which blocks a sparkover of the high voltage pulse from the high voltage source to the output of the high frequency voltage source.

A protection of the isolating element against overvoltage is also achieved in that the isolating element is looped into the second electrical conductor path between the protective circuit and the output of the high frequency voltage source.

In a preferred further development of the invention, the isolating element is looped into the second electrical conductor path between the protective circuit and the third electrode. This has the advantage that the band pass of the isolating element attenuates the energy outside of the band pass range, simplifying the realization of the protective circuit.

An improved transmission of the high voltage from the high voltage source to the spark plug is achieved in that a protective circuit is electrically looped into the first electrical conductor path between the output of the high voltage source and the first electrode of the spark plug which represents a ground reference for the HF.

In a first alternative, on application of the high voltage pulse to the first electrode a first conductive plasma channel is formed between the first electrode and the second electrode and on application of the high frequency alternating voltage to the third electrode a third conductive plasma channel is formed between the third electrode and the second electrode. Thus, through the additional application of a high frequency voltage from the high frequency voltage source to the high frequency electrode, more power can be introduced into the plasma over a longer period of time. As a result, electrons are continuously generated and the free electron density in the plasma is maintained for longer, which is associated with a permanent generation of reactive species (above all of atomic oxygen).

In a second alternative, on application of the high voltage pulse to the first electrode a second conductive plasma channel is formed between the first electrode and the third electrode and a third conductive plasma channel is formed between the third electrode and the second electrode. On application of the high frequency voltage to the third electrode, the third plasma channel between the third electrode and the second electrode is maintained and is propagated over a longer period of time and over a larger space.

The invention is explained in more detail in the following with reference to the drawings.

The preferred embodiment of an ignition device 10 according to the invention represented in FIG. 1 comprises a spark plug 12, a high voltage source or high DC voltage source 14 and a high frequency voltage source 16. The spark plug 12 has a first electrode 18 (high voltage electrode), a second electrode 19 (ground electrode) and a third electrode 20 (high frequency electrode). The second electrode 19 is electrically connected with an electrical ground potential 40. The electrodes 18, 19, 20 project into a combustion chamber, which is not shown, for example into a working cylinder of an internal combustion engine in which a fuel-air mixture is to be ignited. The high voltage source 14 is designed in the form of an ignition coil and generates a high voltage pulse or high DC voltage pulse (DC) which is present at an output 22 of the high voltage source 14. In this case the expression "electrical high DC voltage pulse" refers to an electrical DC voltage pulse with high electrical voltage of a number of kV, for example 3 kV to 30 kV or 8 kV to 12 kV. The output 22 of the high voltage source 14 is electrically connected to the first electrode 18 via a first electrical conductor path 24 such that the high voltage pulse from the high voltage source 14 is fed to the first electrode 18 of the spark plug 12.

The high frequency voltage source 16 generates a high frequency alternating voltage which is present at an output 26 of the high frequency voltage source 16. The output 26 of the high frequency voltage source 16 is electrically connected to the third electrode 20 of the spark plug 12 via a second electrical conductor path 28 such that the high frequency alternating voltage is fed from the high frequency voltage source 16 to the third electrode 20 of the spark plug 12. The high frequency voltage source 16 is also electrically connected to the electrical ground potential 40.

A protective circuit 30 is electrically looped into the second electrical conductor path 28. This protective circuit 30 is configured such that, on the one hand, it prevents the high voltage pulse from the high voltage source 14 from sparking over via the second electrical conductor path 28 to the output 26 of the high frequency voltage source 16 and on the other hand passes on the high frequency alternating voltage from the high frequency voltage source 16 in the direction of the third electrode 20 of the spark plug 12. In this way, the high frequency voltage source 16 is protected against overvoltage.

An isolating element 32 is also electrically looped into the second electrical conductor path 28 between the protective circuit 30 and the output 26 of the high frequency voltage source 16. This isolating element 32 is designed in the form of a frequency selective filter, for example a band pass filter with a constant or variable capacitance 34 and a constant or variable inductance 36. This band pass filter only allows a predetermined frequency band to pass from the high frequency voltage source 16 via the second electrical conductor path 28 in the direction of the third electrode 20. The coupled-in frequency of the high frequency alternating voltage can be continually adjusted with the isolating element 32, so that an optimal input of energy into the ignited plasma is achieved.

The ignition device according to the invention is designed in the form of a high frequency plasma ignition system and includes in the spark plug 12 two active electrodes 18, 20, namely the high voltage electrode as first electrode 18 and the high frequency electrode as third electrode 20 and a ground electrode 19. The ignition coil 14 generates a high voltage pulse or high DC voltage pulse (DC) which, in a first alternative, ignites an initial plasma in the space between the two electrodes 18, 19 (first plasma channel 42) when a breakdown voltage between the high voltage electrode 18 and the ground electrode 19 of the spark plug 12 is reached.

A plasma contains, inter alia, electrons, ions, excited particles and neutral particles. The free charge carriers (electrons and ions) initially form a conductive first plasma channel between the high voltage electrode 18 and the ground electrode 19 of the spark plug 12 (arrow 42). Through subsequent feeding of the high frequency alternating voltage from the high frequency voltage source 16 to the third electrode, which is located within the space of the initial plasma, the initial plasma is maintained in the space between the high frequency electrode 20 and the ground electrode 19 (third plasma channel 44). The plasma is maintained for longer through the input of high frequency energy than would be the case through the high voltage pulse from the high voltage source 14 alone. In particular, the plasma expands spatially from the centre of the third plasma channel 44. The free charge carriers created through the plasma are used for the current transport of the high frequency plasma between the high frequency electrode 20 and the ground electrode 19. Thus, more power can be introduced into the plasma over a longer period of time through the additional application of a high frequency voltage from the high frequency voltage source 16 to the high frequency electrode 20. This means that electrons are generated continuously and the free electron density in the plasma is maintained for longer, which is associated with a permanent generation of reactive species (above all of atomic oxygen). The significantly increased quantity of atomic oxygen ensures a more effective combustion and, inter alia, allows the reliable ignition of lean fuel-air mixtures in the combustion chamber or an increased engine power with constant fuel consumption.

In a second alternative, an initial plasma is formed in a second plasma channel 43 between the first electrode 18 and the third electrode 20 and in a third plasma channel 44 between the third electrode 20 and the ground electrode 19. On feeding the high frequency alternating voltage from the high frequency voltage source 16 to the third electrode 20, the plasma is maintained over time and expands spatially from the center of the third plasma channel 44.

In order to protect the high frequency voltage source 16 against the high voltage pulse from the high voltage source 14, the protective circuit 30 is provided between the high frequency electrode 20 and high frequency voltage source 16. A reliable takeover of the high frequency voltage source in order to continue actively coupling energy into the plasma following the initial sparking through the high voltage pulse from the high voltage source 14 is ensured, since the initial sparking in every case generates free charge carriers between the electrodes.

The protective circuit 30 includes for example a gas-filled surge arrester which has an isolating effect as long as the voltage remains below a predetermined value of for example around 450 V. The gas-filled surge arrester causes no interference due to its low capacitance of only around 2 pF. If the ignition voltage of the gas-filled surge arrester is exceeded, the resistance falls within microseconds to very low values, wherein current peaks of for example 100 kA can be dissipated.

The common ground electrode 19 is the reference potential for the high frequency electrode 20 and the high voltage electrode 18. The requirements in terms of the dielectric strength of the isolating element 32 are drastically reduced through the separation of high voltage and high frequency potential. At the same time, the load on the high voltage source 14 in the form of the ignition coil is significantly reduced through this step and the generation of the high voltage significantly simplified. Against the background of increasingly highly charged and small-volume petrol engines, the generation of sufficiently high voltage pulses to ensure reliable ignition represents an increasingly growing challenge. Furthermore, this leads to more degrees of freedom in the choice of the reactive construction elements of the isolating element, since it is no longer necessary to ensure the lowest possible capacitive load on the ignition coil. The capacitances of the isolating element can be increased in comparison with previous circuit concepts and the inductances can be reduced, which simplifies the realization of the isolating element.

Figure 2:
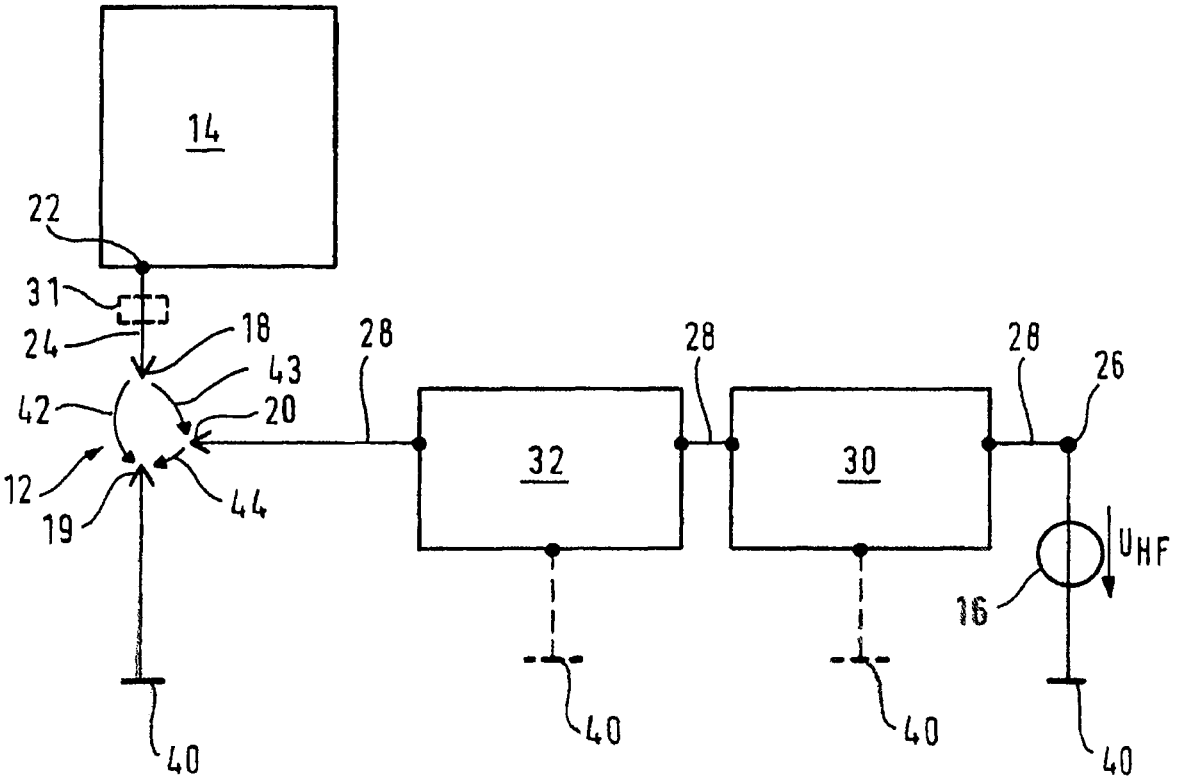
FIG. 2 shows a schematic representation of an alternative preferred embodiment of an ignition device according to the invention.

In FIG. 2, parts with the same function are identified with the same reference symbols as in FIG. 1, so that reference is made to the above description of FIG. 1 with regard to their explanation. In the second embodiment according to FIG. 2, in contrast to the first embodiment according to FIG. 1 the protective circuit 30 is looped into the second electrical conductor path 28 between the isolating element 32 and the output 26 of the high frequency voltage source 16.

Optionally, the protective circuit 30 and/or the isolating element 32 have in addition an electrical connection to the ground potential 40, as illustrated with broken lines in FIGS. 1 and 2.

Optionally, a protective circuit 31 with electrical connection to the ground potential 40 is electrically looped into the first electrical conductor path 24 between the output 22 of the high voltage source 14 and the first electrode 18. This protective circuit 31 is indicated correspondingly in FIGS. 1 and 2 with broken lines. The protective circuit is intended to represent a ground reference for the HF and not block the high voltage.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An ignition device for igniting an air/fuel mixture in a combustion chamber, having a spark plug which has a first electrode and a second electrode, having a high voltage source for generating an electrical high voltage pulse at an output of the high voltage source and having a high frequency voltage source for generating an electrical high frequency alternating voltage at an output of the high frequency voltage source, wherein the output of the high voltage source is electrically connected to the first electrode of the spark plug via a first electrical conductor path such that the high voltage pulse is applied to the first electrode, wherein the second electrode is electrically connected to an electrical ground potential, wherein the spark plug has a third electrode, and wherein the output of the high frequency voltage source is electrically connected to the third electrode via a second electrical conductor path such that the high frequency alternating voltage is applied to the third electrode, and an isolating element in the form of a band pass filter is electrically looped into the second electrical conductor path between the third electrode of the spark plug and the output of the high frequency voltage source, wherein the band pass filter is configured with a capacitance and an inductance.

2. The ignition device of claim 1, wherein the high voltage source is designed in the form of an ignition coil.

3. The ignition device of claim 1, wherein a protective circuit is electrically looped into the second electrical conductor path between the third electrode of the spark plug and the output of the high frequency voltage source which blocks a sparkover of the high voltage pulse from the high voltage source to the output of the high frequency voltage source.

4. The ignition device of claim 1, wherein the isolating element is looped into the second electrical conductor path between the protective circuit and the output of the high frequency voltage source.

5. The ignition device of claim 1, wherein the isolating element is looped into the second electrical conductor path between the protective circuit and the third electrode.

6. The ignition device of claim 1, wherein a protective circuit is electrically looped into the first electrical conductor path between the output of the high voltage source and the first electrode of the spark plug which represents a ground reference for the HF.

7. The ignition device of claim 1, wherein, in a first alternative, on application of the high voltage pulse to the first electrode a first conductive plasma channel is formed between the first electrode and the second electrode and on application of the high frequency alternating voltage to the third electrode a third conductive plasma channel is formed between the third electrode and the second electrode.

8. The ignition device of claim 1, wherein, in a second alternative, on application of the high voltage pulse to the first electrode a second conductive plasma channel is formed between the first electrode and the third electrode and a third conductive plasma channel is formed between the third electrode and the second electrode.

9. The ignition device of claim 1, wherein said combustion chamber is within an internal combustion engine.

10. The ignition device of claim 2, wherein a protective circuit is electrically looped into the second electrical conductor path between the third electrode of the spark plug and the output of the high frequency voltage source which blocks a sparkover of the high voltage pulse from the high voltage source to the output of the high frequency voltage source.

11. The ignition device of claim 3, wherein the isolating element is looped into the second electrical conductor path between the protective circuit and the output of the high frequency voltage source.

12. The ignition device of claim 3, wherein the isolating element is looped into the second electrical conductor path between the protective circuit and the third electrode.

13. The ignition device of claim 11, wherein a protective circuit is electrically looped into the first electrical conductor path between the output of the high voltage source and the first electrode of the spark plug which represents a ground reference for the HF.

14. The ignition device of claim 12, wherein, in a first alternative, on application of the high voltage pulse to the first electrode a first conductive plasma channel is formed between the first electrode and the second electrode and on application of the high frequency alternating voltage to the third electrode a third conductive plasma channel is formed between the third electrode and the second electrode.

15. The ignition device of claim 6, wherein, in a second alternative, on application of the high voltage pulse to the first electrode a second conductive plasma channel is formed between the first electrode and the third electrode and a third conductive plasma channel is formed between the third electrode and the second electrode.

* * * * *